US005178695A

United States Patent [19]

LaSalle et al.

[11] Patent Number: 5,178,695

[45] Date of Patent: Jan. 12, 1993

[54] STRENGTH ENHANCEMENT OF RAPIDLY SOLIDIFIED ALUMINUM-LITHIUM THROUGH DOUBLE AGING

[75] Inventors: Jerry C. LaSalle, Montclair; V. R. V. Ramanan, Dover; David J. Skinner, Long Valley, all of N.J.

[73] Assignee: Allied-Signal Inc., Morris Township, Morris County, N.J.

[21] Appl. No.: 782,951

[22] Filed: Oct. 25, 1991

Related U.S. Application Data

[63] Continuation-in-part of Ser. No. 672,990, Mar. 21, 1991, which is a continuation-in-part of Ser. No. 517,774, May 2, 1990, abandoned.

[51] Int. Cl.[5] ..... C22F 1/04

[52] U.S. Cl. ..... 148/698; 148/416; 148/417; 148/439; 148/688; 148/699; 148/700; 420/533; 420/552

[58] Field of Search ..... 148/3, 11.5 A, 12.7 A, 148/159, 415, 417, 439, 416, 688, 698, 699, 700; 420/552, 533

[56] References Cited

U.S. PATENT DOCUMENTS 4,747,884 5/1988 Gayle et al. ..... 148/3
4,842,822 6/1989 Colvin et al. ..... 420/533

OTHER PUBLICATIONS

Conference Proceedings of Aluminum-Lithium V, ed. T. H. Sanders & E. A. Starke, pub. MCE (1989).

*Primary Examiner*—R. Dean
*Assistant Examiner*—Robert R. Koehler
*Attorney, Agent, or Firm*—Ernest D. Buff; Gerhard H. Fuchs

[57] ABSTRACT

A component consolidated from a rapidly solidified aluminum-lithium alloy containing copper, magnesium and zirconium is subjected to a preliminary aging treatment at a temperature of about 400° C. to 500° C. for a time period of about 0.5 to 10 hours; quenched in a fluid bath; and subjected to a final aging treatment at a temperature of about 100° C. to 250° C. for a time period ranging up to about 40 hours. The component exhibits increased strength and elongation, and is especially suited for use in lightweight structural parts for land vehicles and aerospace applications.

10 Claims, 5 Drawing Sheets

STRENGTH ENHANCEMENT OF RAPIDLY SOLIDIFIED ALUMINUM-LITHIUM THROUGH DOUBLE AGING

CROSS REFERENCE TO RELATED APPLICATIONS

This is a continuation-in-part of copending U.S. patent application Ser. No. 672,990, filed Mar. 21, 1991 which, in turn, is a continuation-in-part, of U.S. patent application Ser. No. 517,774, filed May 2, 1990, now abandoned.

FIELD OF INVENTION

The invention relates to rapidly solidified aluminum-lithium-copper-magnesium-zirconium powder metallurgy components having a combination of high ductility and high tensile strength; and more particularly to a process wherein the components are subjected to thermal treatment which improves yield and ultimate strengths thereof with minimal loss in tensile ductility.

BRIEF DESCRIPTION OF THE PRIOR ART

The need for structural aerospace alloys of improved specific strength and specific modulus has long been present. It is known that the elements lithium, beryllium, boron, and magnesium can be added to an aluminum alloy to decrease its density. Conventional methods for producing aluminum alloys, such as direct chill (DC), continuous and semi-continuous casting, yield aluminum alloys having up to 5 wt % magnesium or beryllium; but such alloys are inadequate for use in applications requiring a combination of high strength and low density. Lithium contents of about 2.5 wt % have been satisfactorily incorporated into the lithium-copper-magnesium family of aluminum alloys, including those alloys designated 8090, 8091, 2090 and 2091. These alloys have copper and magnesium additions in the 1 to 3 wt % and 0.25 to 1.5 wt % range, respectively. In addition, zirconium is also added for grain refinement at levels up to 0.16 wt %.

The above alloys derive strength and toughness through the formation of several precipitate phases, which are described in detail in the Conference Proceedings of Aluminum-Lithium V, edited by T. H. Sanders and E. A. Starke, pub. MCE, (1989). An important strengthening precipitate in aluminum-lithium alloys is the metastable δ'phase which has a well defined solvus line. Thus, aluminum-lithium alloys are heat treatable, their strength increasing as δ' homogeneously nucleates from the supersaturated aluminum matrix.

The δ' phase consists of the ordered $L1_2$ crystal structure and the composition $Al_3Li$. The phase has a very small lattice misfit with the surrounding aluminum matrix and thus a coherent interface with the matrix. Dislocations easily shear the precipitates during deformation, resulting in the buildup of planar slip bands. This, in turn, reduces the toughness of aluminum lithium alloys. In binary aluminum-lithium alloys where this is the only strengthening phase employed, the slip planarity results in reduced toughness.

The addition of copper and magnesium to aluminum-lithium alloys has two beneficial effects. First, the elements reduce the solubility of lithium in aluminum, increasing the amount of strengthening precipitates available. More importantly, however, the copper and magnesium allow the formation of additional precipitate phases, most importantly the orthorhombic S' phase ($Al_2MgLi$) and the hexagonal $T_1$ phase ($Al_2CuLi$). Unlike δ', these phases are resistant to shearing by dislocations and are effective in minimizing slip planarity. The resulting homogeneity of the deformation results in improved toughness, increasing the applicability of these alloys over binary aluminum-lithium. Unfortunately, these phases form sluggishly, precipitating primarily on heterogeneous nucleation sites such as dislocations. In order to generate these nucleations sites, the alloys must be cold worked prior to aging.

Zirconium, at levels under approximately 0.15 wt %, is typically added to the alloys to form the metastable $Al_3Zr$ phase for grain size control and to retard recrystallization. Metastable $Al_3Zr$ consists of an $L1_2$ crystal structure which is essentially isostructural with δ' ($Al_3Li$). Additions of zirconium to aluminum beyond 0.15 wt % using conventional casting practice result in the formation of relatively large dispersoids of equilibrium $Al_3Zr$ having the tetragonal $DO_{23}$ structure which are detrimental to toughness.

Much work has been done to develop the aforementioned alloys, which are currently near commercialization. However, the processing constraint imposed by the need for cold deformation has limited the application of these alloys to thin, low dimensional shapes such as sheet and plate. Complex, shaped components such as forgings are not amenable to such processing. Hence, conventional aluminum-lithium alloy forgings lack the combination of strength, ductility, and low density required for aerospace structural applications.

SUMMARY OF THE INVENTION

The invention provides a method for increasing the tensile strength of a component composed of a rapidly solidified aluminum-lithium-copper-magnesium-zirconium alloy by subjecting the component to a multi-step aging treatment. Generally stated, the component is a consolidated article, formed from an alloy that is rapidly solidified and consists essentially of the formula $Al_{bal}Li_aCu_bMg_cZr_d$ wherein "a" ranges from about 2.1 to 3.4 wt %, "b" ranges from 0.5 to 2.0 wt %, "c" ranges from 0.2 to 2.0 wt %, and "d" ranges from about 0.2 to 0.6 wt %, the balance being aluminum. The aging treatment to which the component is subjected comprises the steps of subjecting the component to a preliminary aging treatment at a temperature of about 400° C.–500° C. for a time period ranging from about 0.5 to 10 hours; quenching the component in a fluid bath; and subjecting the component to a final aging treatment at a temperature of about 100° C.–250° C. for a time period ranging up to about 40 hours.

In addition, the invention provides a component consolidated from a rapidly solidified aluminum-lithium alloy of the type delineated, which component has been subjected to the multi-step aging treatment specified hereinabove.

It has been found that when specific components consolidated from rapidly solidified alloys of the composition delineated are subjected to the multi-step aging treatment specified , they exhibit increased strength and elongation, as compared with components that are thermally processed in a conventional manner. The improved combination of properties afforded by components of the invention renders them especially suited for lightweight structural parts used in automobile, aircraft or spacecraft applications.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENT

Figure 1:
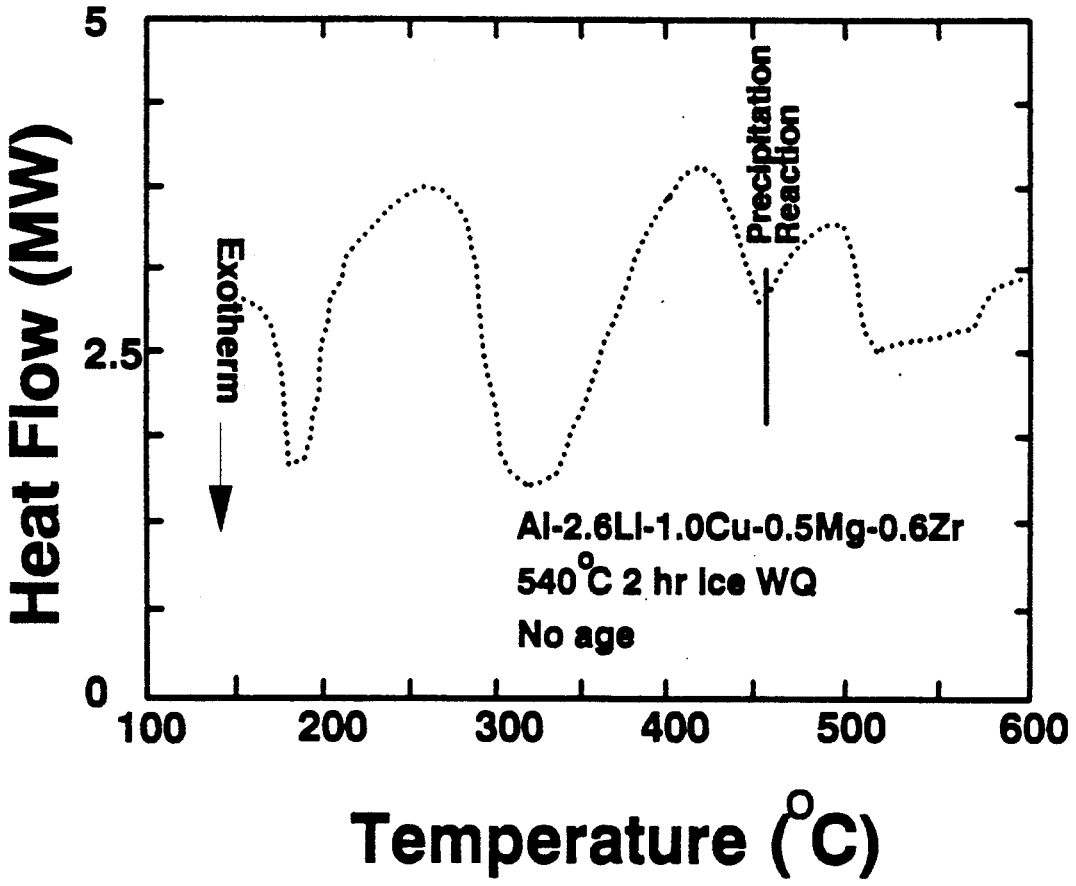
FIG. 1 is a graph depicting the heat evolution/absorption vs. temperature as measured by differential scanning calorimetry for an Al-2.6Li-1.0Cu-0.5Mg-0.6Zr alloy aged at 540° C. for 2 hours and ice water quenched.

The invention provides a thermal treatment that increases the tensile strength of a low density rapidly solidified aluminum-base alloy, consisting essentially of the formula $Al_{bal}Li_aCu_bMg_cZr_d$ wherein "a" ranges from 2.1 to 3.4 wt %, "b" rang®s from about 0.5 to 2.0 wt %, "o" ranges from 0.2 to 2.0 wt %, "d" ranges from about 0.2 to 0.6 wt % and the balance is aluminum.

The thermal treatment to which the alloy is subjected involves several thermal process steps, i.e. 1) solutionization, 2) preliminary aging and 3) double aging as defined hereinafter. Solutionization refers to the absorption of lithium containing phases such as $Al_3Li(\delta')$, $AlLi(\delta)$, and/or lithium, copper, magnesium containing phases, for example $T_1$ and S' phases ($Al_2CuMg$, $Al_2CuLi$, $Al_2MgLi$, etc.). Solutionization of these phases into the aluminum lattice occurs at temperatures above approximately 450° C. The alloy is said to be solutionized when held above this temperature for sufficient time to dissolve these phases. A quench in a fluid bath is generally employed to prevent reformation of these phases upon cooling to room temperature.

Although the lithium, magnesium, and/or copper containing phases are dissolved at these temperatures and the alloy is solutionized with respect to these phases, the alloy is not solutionized with respect to the metastable phase having the $L1_2$ crystal structure which consists essentially of the composition $Al_3Zr$, although certain amounts of Li, Cu, and/or Mg may be present in this phase.

The $L1_2$ phase, which is formed above 450° C., is comprised of the precipitates which result during the thermal process step defined as the preliminary age. Surprisingly, this precipitate formation occurs simultaneously with the solutionization of the $\delta$ and $\delta'$ phases. Thus, above 450° C. both solutionization and preliminary aging is occurring.

Double aging includes two thermal process steps, the first step being the preliminary age above 450° C. for the formation of metastable $L1_2$ phase containing predominately Al and Zr, and the second step being a low temperature aging treatment between approximately 120° C. and 200° C. where the $Al_3Li$ phase precipitates.

Rapid solidification is defined as any cooling rate greater than about $10^{3}$° C./sec and includes powder processes such as melt atomization, spray forming and the like. Preferably, the alloys of the invention are rapidly solidified by quenching and solidifying a melt of a desired composition at a rate of at least about $10^{5}$° C./sec onto a moving, chilled casting surface. The casting surface may be, for example, the peripheral surface of a chill roll or the chill surface of an endless casting belt. Preferably, the casting surface moves at a speed of at least about 9,000 feet/minute (2750 m/min) to provide a cast alloy strip approximately 30–40 micrometers in thickness, which has been uniformly quenched at the desired quench rate. Such strip can be 4" or more in width, depending upon the casting method and apparatus employed. Suitable casting techniques include, for example, jet casting and planar flow casting through a slot-type orifice.

In accordance with the invention, the rapidly solidified and then compacted alloy or component is subjected to a preliminary thermal treatment at temperatures ranging from about 400° C. to 500° C. for a period of approximately 0.5 to 10 hours. While not being bound by theory, it is believed that this treatment dissolves elements such as Cu, Mg, and Li which may be microsegregated in precipitated phases such as $\delta'$, $\delta$, $T_1$ and S'. In addition, the treatment produces an optimized distribution of cubic $L1_2$ particles ranging from about 5 to 50 nanometers in size. The alloy article is then quenched in a fluid bath, preferably held between 0° and 60° C. As used hereinafter in the specification and claims, the term "preliminary aging" is intended to define the thermal treatment described in the first sentence of this paragraph. The compacted article is then aged at a temperature ranging from about 100° C. to 250° C. for a time period ranging up to about 40 hours to provide selected strength/toughness tempers. No cold deformation step is required during this thermal processing, with the result that complex shaped components such as forgings produced from the aged component have excellent mechanical properties.

Preliminary aging below approximately 400° C. results in a deleterious drop in tensile properties due to the formation of undesirable phases such as the $\delta$ (AlLi) phase. Preliminary aging above approximately 500° C. results in an acceptable combination of tensile properties but does not result in the attainment of the optimum tensile strength since the volume fraction of precipitates is reduced. Grain coarsening may also occur at temperature beyond 550° C., further reducing strength.

Consolidated articles aged in accordance with the invention exhibit tensile yield strength ranging from about 400 MPa (58 ksi) to 545 MPa (79 ksi), ultimate tensile strength ranging from about 510 MPa (74ksi) to MPa (83 ksi), elongation to fracture ranging from about 4 to 9%, and transverse notched impact energies ranging from about $1.5\times10^{-2}$ to $2.8\times10^{-2}$ Joules/mm$^2$, when measured at room temperature (20° C.).

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES 1-3

Thermal processing in accordance With the invention was carried out on extruded bar made from rapidly solidified alloys having compositions (in wt %) listed in Table I. The ternary composition Al-2.5Li-1.0Zr was also produced via rapid solidification and is included for comparative purposes.

TABLE I

| |
|---|
| 1. Al—2.1Li—1.0Cu—0.5Mg—0.2Zr |
| 2. Al—2.6Li—1.0Cu—0.5Mg—0.4Zr |
| 3. Al—2.6Li—1.0Cu—0.5Mg—0.6Zr |

EXAMPLE 4

Al-2.6Li-1.0Cu-0.5Mg-0.6Zr, made via rapid solidification and formed into an extrusion, was given a preliminary age at 540° C. for 2 hours and ice water quenched. The heat evolution/absorption as a function of temperature was then measured using the technique of differential scanning calorimetry (DSC), shown in FIG. 1. The peaks in FIG. 1 represent the dissolution of precipitate phases during heating while the troughs represent precipitation. A precipitation reaction is represented by the trough centered at 450° C. It is this precipitation reaction which is responsible for the enhanced strength resulting from the preliminary aging treatment.

EXAMPLE 5

The tensile properties of consolidated articles formed by extrusion of the alloys listed in Table I and thermally processed in accordance with the method of the invention are listed in Table II. The extruded bars were given a preliminary age for 2 hours at temperatures between 400° C. and 600° C. and quenched into an ice water bath; subsequently, they were aged at 135° C. for 16 hours. Transverse specimens Were then cut and machined into round tensile specimens having a gauge diameter of $\frac{3}{8}$ inches and a gauge length of $\frac{3}{4}$ inches. Tensile testing was performed at room temperature at a strain rate of $5.5\times10^{-4}\text{sec}^{-1}$.

TABLE II

| Composition (wt %) Aging Temp. | 0.2% YS (MPa) | UTS (MPa) | Elong. to fract. (%) | Impact Toughness Joule/mm$^2$ |
|---|---|---|---|---|
| Al—2.6Li—1.0Cu—0.5Mg—0.2Zr | | | | |
| 400° C. | 400 | 435 | 4.9 | |
| 440° C. | 410 | 495 | 7.2 | |
| 490° C. | 395 | 500 | 6.3 | |
| 540° C. | 350 | 470 | 8.0 | $2.6\times10^{-2}$ |
| 590° C. | 340 | 460 | 6.9 | |
| Al—2.6Li—1.0Cu—0.5Mg—0.4Zr | | | | |
| 540° C. | 410 | 535 | 9.4 | $1.9\times10^{-2}$ |
| Al—2.6Li—1.0Cu—0.5Mg—0.6Zr | | | | |
| 400° C. | 500 | 510 | 5.2 | $8.5\times10^{-3}$ |
| 440° C. | 490 | 535 | 6.9 | $1.6\times10^{-2}$ |
| 490° C. | 470 | 540 | 7.7 | $2.1\times10^{-2}$ |
| 540° C. | 440 | 520 | 5.8 | $2.3\times10^{-2}$ |
| 590° C. | 395 | 515 | 8.3 | $2.6\times10^{-2}$ |
| Al—2.5Li—1.07Zr | | | | |
| 540° C. | 410 | 425 | 9.5 | $2.2\times10^{-2}$ |

Figure 2:
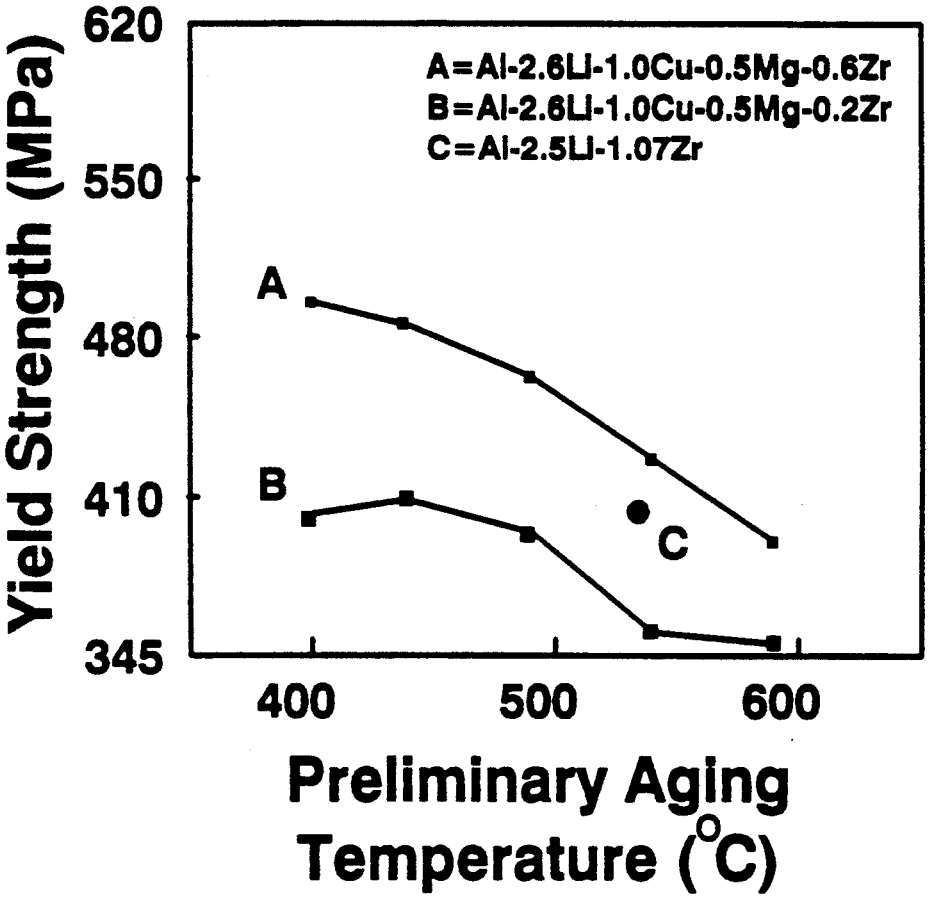
FIG. 2 is a graph for the alloys of Table I of the yield strength vs. aging temperature of a transverse specimen cut from an extruded bar aged for 2 hrs. followed by an ice water quench and subsequent aging for 16 hrs. at 135° C., the open rectangle providing data for a transverse specimen cut from an Al-2.5Li-1.07Zr extruded bar; the specimen being aged at 540° C. for 2 hrs. was water quenched and subsequently aged at 135° C. for 16 hours.
Figure 3:
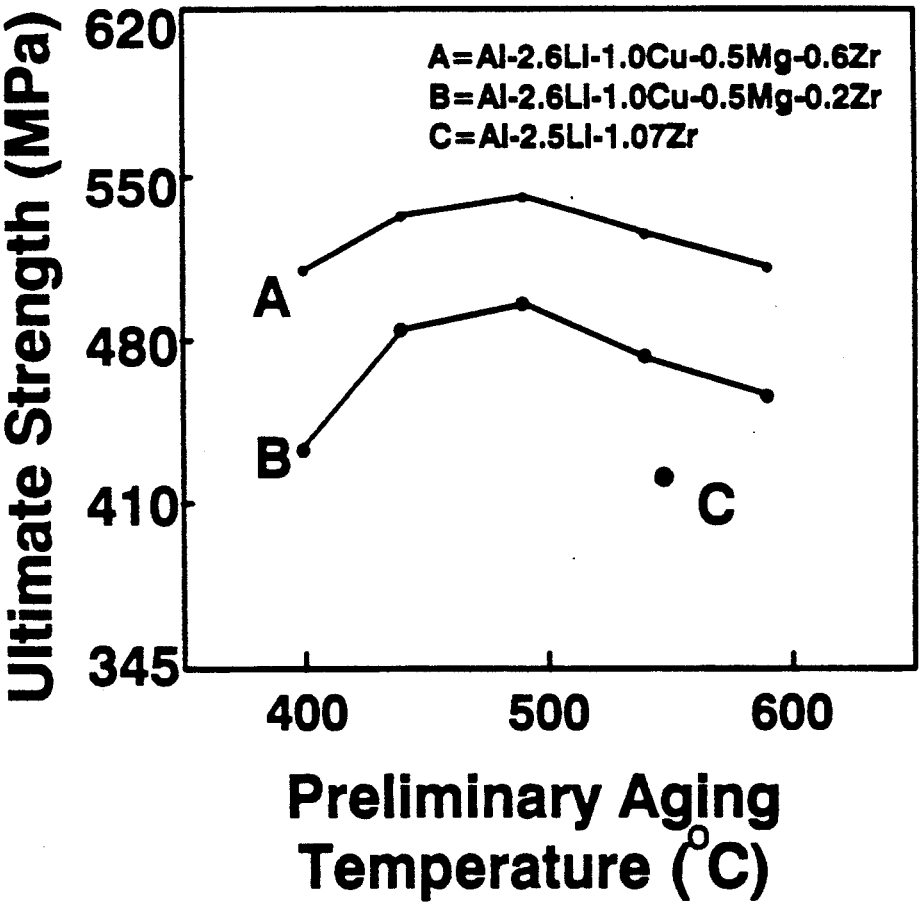
FIG. 3 is a graph of the ultimate tensile strength vs. aging temperature for specimens aged in the manner of the specimens of FIG. 2.
Figure 4:
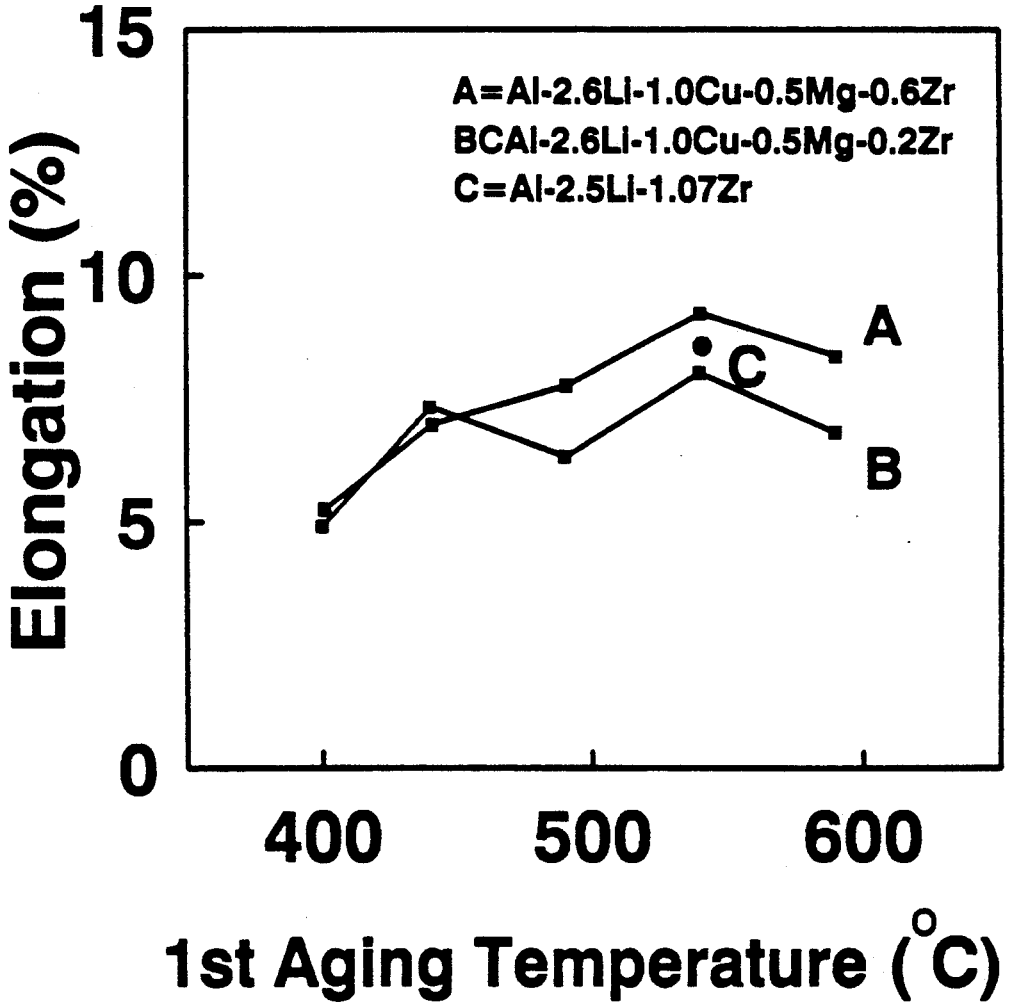
FIG. 4 is a graph of the tensile elongation vs. aging temperature for specimens aged in the manner of the specimens of FIG. 2.

FIGS. 2, 3, and 4 are graphs of the data listed in Table II. The graphs illustrate that the peak ultimate tensile strength (UTS) is a function of both zirconium content and temperature of the first aging treatment. For example, a peak UTS of 540 MPa is obtained for a 490° C. preliminary aged Al-2.6Li-1.0MG-0.6Zr.

Also included for comparative purposes in the FIGS. 2, 3, and 4 is the transverse tensile data for an Al-2.5Li-1.07Zr extrude bar. It is clear that the combination of tensile strength and elongation of the Al-Li-Cu-Mg-Zr alloys of this invention are superior to those of the Al-2.5Li-1.07Zr.

Figure 5:
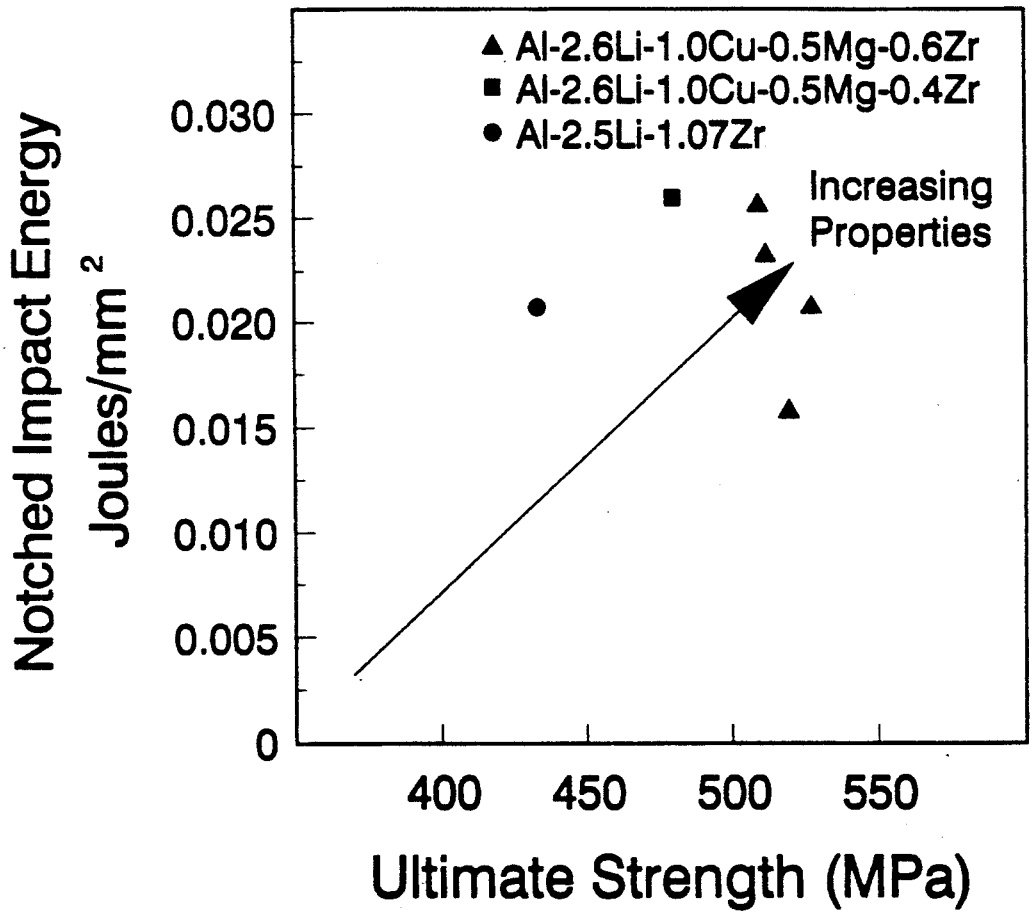
FIG. 5 is a graph depicting the ultimate strength vs. elongation for the alloys of FIG. 2 illustrating the improvement in properties extant along the diagonal away from the origin.

FIG. 5 is a graph of the ultimate tensile strength vs. notched impact energy for the alloys listed in Table II. The graph illustrates that the Al-Li-Cu-Mg-Zr alloys have a strength-toughness combination superior to the ternary Al-Li-Zr alloy.

EXAMPLES 6

This example illustrates that the enhanced strength regulating from control of the preliminary age is greater than and thus distinct from merely extending the aging time of the second low temperature aging treatment. The tensile yield strengths for an Al-2.6LiO1.0Cu-0.5Mg-0.6Zr extrusion measured in the manner set forth in Example 5 are listed in Table III. Reducing the preliminary aging temperature from 540° C. to 400° C. results in a 14% increase in tensile strength compared with only 4% increase in strength when a 540° C. preliminary aged specimen is aged for double the time 135° C.

TABLE III

| Thermal Treatment | YS (MPa) |
|---|---|
| 400° C.-2 hr ice WQ; 135° C.-16 hr | 500 |
| 540° C.-2 hr ice WQ; 135° C.-16 hr | 440 |
| 540° C.-2 hr ice WQ; 135° C.-32 hr | 460 |

EXAMPLE 7

This example illustrates that a precipitation reaction is occurring during the preliminary age above 450° C. Consolidated articles made from melt spun ribbon of the composition Al-2.6Li-1.0Cu-0.5Mg-0.6Zr were held at the temperatures listed in Table IV for 2 hrs. and water quenched.

TABLE IV

| Temp °C. | Rockwell B Hardness |
|---|---|
| 400 | 44 |
| 450 | 47 |
| 500 | 49 |
| 550 | 48 |
| 600 | 41 |

The resulting hardness of the material was measured using the standard Rockwell hardness B scale. Table IV shows that the hardness is a function of temperature, the highest hardness occurring at 500° C. This increase in hardness is ascribed to a classic precipitation phenomenon, in this case to the formation of the metastable $L1_2$ precipitate containing Zr.

Having thus described the invention in rather full detail, it will be understood that these details need not be strictly adhered to but that various changes and modifications may suggest themselves to one skilled in the art, all falling within the scope of the invention as defined by the subjoined claims.

What is claimed is:

1. A process for increasing the strength of a rapidly solidified aluminum-lithium alloy component, comprising the steps of:

a. subjecting the component to a preliminary aging treatment at a temperature of about 400° C. to 500° C. for a time period from about 0.5 to 10 hours;

b. quenching the component in a fluid bath; and, c. subjecting the component to final treatment at a temperature of about 100° C. to 250° C. for a time period ranging up to about 40 hours, said component being a consolidated article formed from an aluminum-lithium alloy that is rapidly solidified and consists essentially of the formula $Al_{bal}Li_aCu_bMg_cZr_d$ wherein "a" ranges from about 2.1 to 3.4 wt %, "b" ranges from about 0.5 to 2.0 wt %, "c" ranges from about 0.2 to 2.0 wt % and "d" ranges from about 0.2 to 0.6 wt %, the balance being aluminum.

2. A process as recited by claim 1, wherein said component has the composition 2.6 wt % lithium, 1.0 wt % copper, 0.5 wt % magnesium and 0.6 wt % zirconium, the balance being aluminum.

3. A process as recited by claim 2, wherein said component, after final aging, has a 0.2% tensile yield strength of 440 MPa, ultimate tensile strength of 530 MPa, and elongation to fracture of 6% and a transverse notched impact toughness of $2.3\times10^{-2}$ Joules/mm$^2$.

4. A process as recited by claim 1, wherein said component has the composition 2.6 wt % lithium, 1.0 wt % copper, 0.5 wt % magnesium and 0.4 wt % zirconium, the balance being aluminum.

5. A process as recited by claim 4, wherein said component, after final aging, has 0.2% tensile yield strength of about 410 MPa, ultimate tensile strength of 535 MPa, elongation to fracture of 9.4% and a transverse notched impact toughness of $2.6\times10^{-2}$ Joules/mm$^2$.

6. A component consolidated from an alloy that is rapidly solidified and consists essentially of the formula $Al_{bal}Li_aCu_bMg_cZr_d$ wherein "a" ranges from about 2.1 to 3.4 wt %, "b" ranges from about 0.5 to 2.0 wt %, "c" ranges from about 0.2 to 2.0 wt %, and "d" ranges from about 0.2 to 0.6 wt %, the balance being aluminum, said component having been subjected to a preliminary aging treatment at a temperature of about 400° C. to 500° C. for a time period of about 0.5 to 10 hours, quenched in a fluid bath and subjected to a final aging treatment at a temperature of about 100° C. to 250° C. for a time period ranging up to about 40 hours.

7. A component as recited by claim 6, wherein said alloy has the composition 2.6 wt % lithium, 1.0 wt % copper, 0.5 wt % magnesium and 0.6 wt % zirconium, the balance being aluminum.

8. A component as recited by claim 7, having a 0.2% tensile yield strength of 440 MPa, ultimate tensile strength of 530 MPa, elongation to fracture of 6% and a transverse notched impact toughness of $2.3\times10^{-2}$ Joules/mm$^2$.

9. A component as recited by claim 6, wherein said alloy has the composition 2.6 wt % lithium. 1.0 wt % copper, 0.5 wt % magnesium and 0.4 wt % zirconium, the balance being aluminum.

10. A component as recited by claim 9, having 0.2% tensile yield strength of 410 MPa, ultimate tensile strength of 535 MPa and elongation to fracture of 9.4% and a transverse notched impact toughness of $2.6\times10^{-2}$ Joules/mm$^2$.

* * * * *